United States Patent [19]

Hill

[11] 4,267,645

[45] May 19, 1981

[54] BURNER-FIRED COMBINED WITH WOOD-FIRED APPARATUS FOR DRYING CROPS

[76] Inventor: Edwin W. Hill, Rte. 2, Box 130, Smithfield, N.C. 27577

[21] Appl. No.: 87,096

[22] Filed: Oct. 22, 1979

[51] Int. Cl.[3] ..... F26B 19/00

[52] U.S. Cl. ..... 34/213; 34/215

[58] Field of Search ..... 165/DIG. 2; 34/213, 34/215; 237/46, 51; 126/101

[56] References Cited

U.S. PATENT DOCUMENTS 1,282,825 10/1918 Harvey ..... 34/214

1,580,767 4/1926 Skromme ..... 34/214

2,838,420 6/1958 Valente ..... 34/216

*Primary Examiner*—Henry C. Yuen

*Assistant Examiner*—Henry Bennett

*Attorney, Agent, or Firm*—B. B. Olive

[57] ABSTRACT

An energy efficient crop-drying and curing system particularly suited for tobacco curing comprises a plurality of conventional oil or gas burner equipped barns illustrated as bulk-curing tobacco barns and an auxiliary wood furnace arranged so that the wood-provided heat can be selectively furnished to any of the barns as a sole or supplemental source of heat.

6 Claims, 4 Drawing Figures

BURNER-FIRED COMBINED WITH WOOD-FIRED APPARATUS FOR DRYING CROPS

BACKGROUND OF THE INVENTION

1. Field of the Invention

This invention relates to apparatus for drying and curing of crops and particularly to wood-burning apparatus associated with such operations.

2. Description of the Prior Art

It has been the practice for many years to employ oil or gas, e.g., bottled gas, fired burners for drying and curing of crops. Bulk curing tobacco barns, for example, have been heated in this manner for many years. Before the advent of oil and gas burners, it was also, of course, known to dry and cure crops with heat obtained by burning wood. However, to applicant's knowledge, no barn system has yet been developed and commercialized, particularly for bulk curing of tobacco, which provides for an auxiliary wood furnace to be used in conjunction with a conventional oil or gas burner system. Therefore, the provision of a crop-drying or curing barn system which incorporates an auxiliary wood furnace as a sole or supplemental heat source becomes the principal object of the invention. Other objects will appear as the description proceeds.

SUMMARY OF THE INVENTION

The invention is illustrated in a preferred embodiment as being applied to a bulk tobacco curing operation.

As illustrated in the preferred embodiment, a plurality of bulk curing tobacco barn structures having associated oil or gas heaters are located substantially close together and have the auxiliary wood furnace of the invention situated substantially centrally of the layout of the barns. The wood furnace of the invention provides a firebox in which wood is burned and above the firebox has a heat exchange unit. The heat exchange unit is removable through the top of the furnace for servicing and is made up of a set of heat chambers, each of which communicates with associated piping with one of the barns. A fan associated with the conventional burner for each barn which is being used for a crop drying operation is operated continuously so that cooled air can be withdrawn from each barn through a return air duct, heated in one of the heat chambers and then returned through a hot air duct back to the same barn to be recirculated through the drying or curing compartment. Appropriate heat sensors, controls and dampers allow the wood furnace to be the sole source of heat for a particular barn over a selected period of time or when necessary to provide supplemental wood furnace heat to such barn to supplement the heat being provided at the same time by the conventional oil or gas burner. A single barn only can be heated, if desired.

DESCRIPTION OF THE PREFERRED EMBODIMENT

Figure 1:
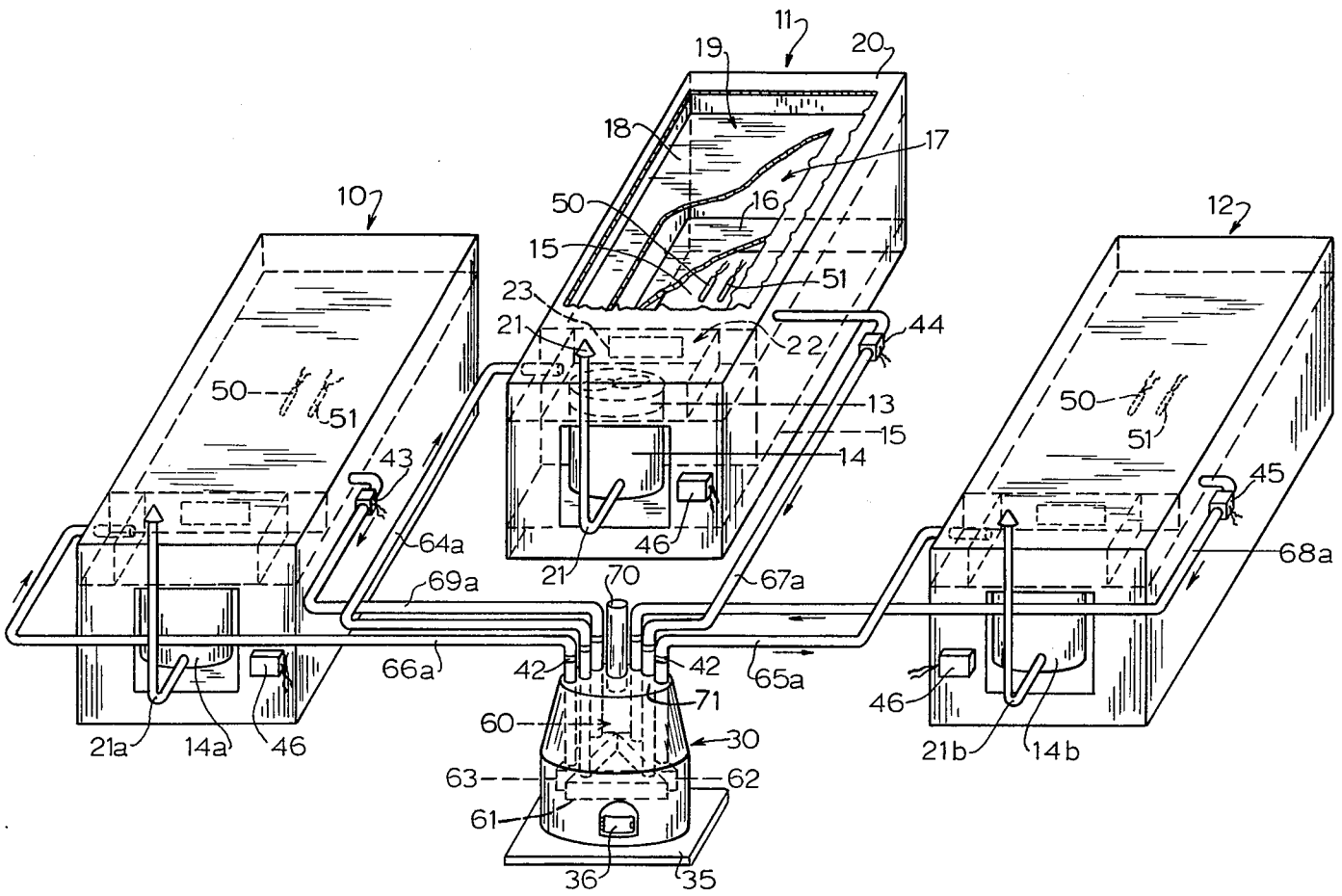
FIG. 1 is a pictorial view of a complete system showing the wood furnace of the invention associated with three bulk tobacco barns of the oil or gas burner type.
Figure 2:
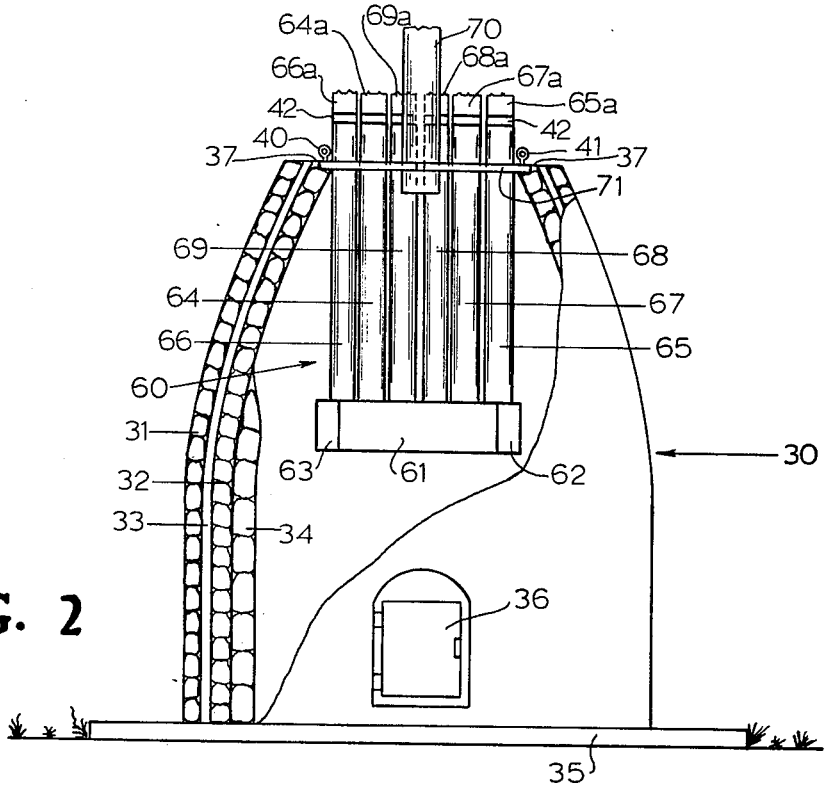
FIG. 2 is a side elevation of the wood furnace of the invention with a portion of the wall broken away to show the furnace walls, the heat chambers making up the heat exchange unit, the furnace piping and the furnace smokestack.

Referring to the drawings and specifically to FIG. 1, three conventional bulk tobacco curing barns 10, 11, 12 are shown. Barn 11 will be referred to for a detailed description since all three barns may be presumed as being of similar construction. The heated air in barn 11 is circulated by means of a fan blower 13 which pulls the air downwardly through an oil or gas-fired heater 14 and into a plenum chamber 15 beneath the floor 16 of barn 11. Fan blower 13 is typically driven by an electric motor and is kept in continuous operation at all times irrespective of whether heater 14 is or is not being fired. The heated air passes from the plenum chamber 15 through a perforated floor 16 into the curing chamber 17 in which the bulk tobacco, not shown, is dried and cured. After leaving the curing chamber 17 the now somewhat cooled air passes through the perforated chamber roof 18 and collects in an upper return air plenum 19 located immediately below the barn roof 20. The air within the upper plenum 19 is typically at, at least, a slight positive pressure and is drawn by the fan blower 13 on its intake side into heater 14 for recycling. Heater 14 normally includes an exhaust stack 21 and barns 10 and 12 are equipped with similar heaters 14*a*, 14*b* and stacks 21*a* and 21*b*.

What has just been described is a generalized description of a typical bulk barn oil or gas-fired heating arrangement. It should, of course, be understood that the exact construction of such bulk tobacco barns may vary considerably from the construction illustrated in FIG. 1. However, all such bulk tobacco barns are generally characterized by having some type of oil or gas-fired heater, a constantly running fan blower, a curing chamber and means to circulate the heated air either up or down through the crop, e.g., tobacco, stored in the curing compartment to effect the drying and curing process. Since the invention is primarily concerned with the association of an auxiliary wood furnace with a conventional oil or gas burner of the type described, the description will now refer to the construction of the auxiliary wood furnace 30 as illustrated in FIGS. 1–4.

Furnace 30 in the illustrated embodiment comprises an outer wall of brick 31 and an inner wall of brick 32 with an air gap 33 therebetween for insulation purposes. An inner lining 34 of firebrick surrounds the firebox area in which the fire is contained. Furnace 30 is preferably situated on a concrete base 35 for stable support and ground insulation purposes. An outwardly opening door 36 mounts on the front of furnace 30 and provides a means through which the wood is placed in furnace 30 and through which any ashes may be removed. Furnace 30 is illustrated as being in a frustum shape although other shapes might be adaopted. A top opening 37 in furnace 30 is of sufficient diameter to allow for insertion and removal of the heat exchange unit 60 next to be described.

Heat exchange unit 60 is formed of metal and comprises three separate horizontally positioned elongated heat chambers 61, 62, 63, vertically positioned heat delivery pipes 64, 65, 66, vertical return pipes 67, 68, 79, smokestack 70 and cover plate 71. Cover plate 71 comprises a circular metal plate of a diameter sufficient to cover opening 37 of furnace 30 and is adapted to rest on the top layer of the inner wall bricks 32 in a mud or other sealer composition, to prevent escape of smoke around the periphery of plate 71. Plate 71 is also made of sufficient thickness or is appropriately reinforced with bars or other means so as to be able to support the overall weight of the heat exchange unit 60 when installed within furnace 30. Pipes 64–69 pass through holes 72–77 respectively and are integrally secured to plate 71 by welding with a predetermined portion of pipes 64–69 extending above plate 71.

Figure 3:
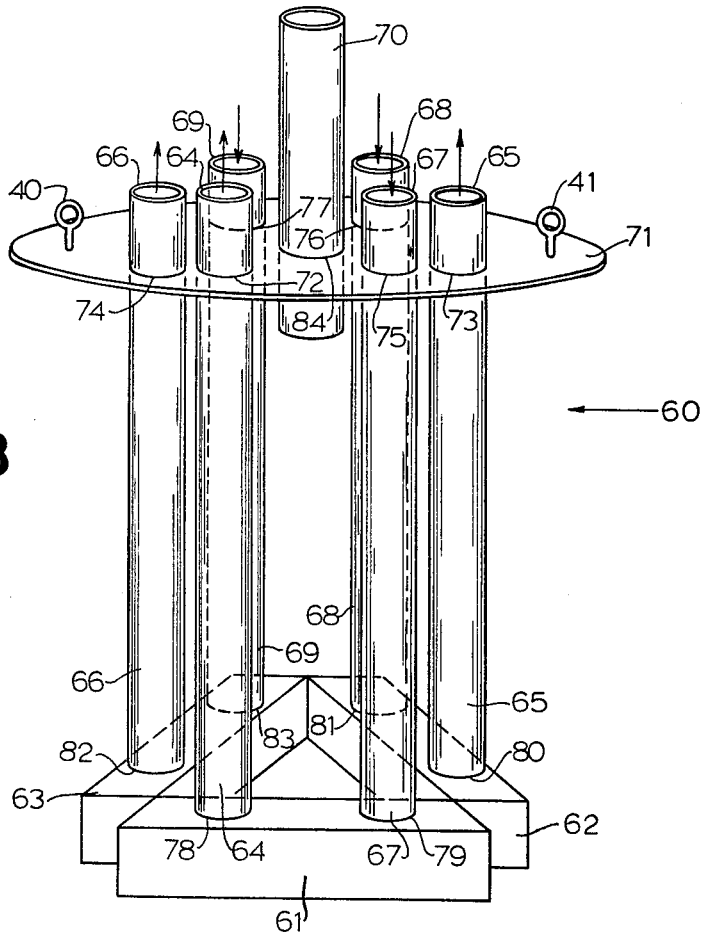
FIG. 3 is a perspective view of the heat exchange unit as it appears removed from the wood furnace of the invention.

The individual heat chambers 61, 62, 63 are integrally secured together by welding and assume a somewhat triangular shape, in plan, as best seen in FIG. 3. Pipes 64 and 67 at their bottom ends extend through holes 78, 79 in chamber 61 where they are secured by welding. In a similar manner, the lower ends of pipes 65 and 68 pass through holes 80, 81 and are secured by welding around such holes in chamber 62. Similarly, pipes 66 and 69 pass through holes 82, 83 in chamber 63 and are secured around such holes by welding. The smokestack 70 passes through hole 84 in plate 71 and is also secured thereto by welding. Smokestack 70 extends below plate 71 for a sufficient distance to facilitate the desired draft and extends for a predetermined distance above plate 71 for the same purpose.

One of the advantages afforded by the invention is that the heat exchange unit 60 can be assembled as an integral unit, as illustrated in FIG. 3, and can be lowered through the opening 37 of furnace 30 after furnace 30 has been completed except for installation of the heat exchange unit 60. Also, when it is necessary to replace firebricks or othewise repair the interior of furnace 30, the entire heat exchange unit 60 may be readily removed. For this purpose, hooks 40, 41 are integrally secured to the top of cover plate 71 and are situated for attachment to chains, cables or the like for use with a hoist to remove the heat exchange unit 60 through the furnace top opening 37.

Couplings 42 secure the pipes 64–69 to the pipes **64*a*–69*a* which extend from the wood furnace 30 to the respective barns 10, 11 and 12 for supply of wood heated air from furnace 30 to the barns and for return air to move from the barns 10, 11 and 12 back to the furnace 30. Couplings 42 may be secured to pipes 64–69 and 64*a*–69*a* by bolts, screws or any other suitable means although an easily detachable and removable means is preferred so as to facilitate removal of the heat exchange unit 60 from the furnace 30** when necessary.

Pipes **66*a*, 64*a* and 65*a* which carry the wood-heated air from the furnace 30 to the respective barns 10, 11 and 12 communicate with the blower chamber 22 of each barn immediately above the fan for such barn and provide a means for the hot air to enter on the intake side of the respective heaters 14*a*, 14 and 14*b*, respectively. Thus, heated air from furnace 30 is delivered into the respective blower chambers 22, is forced through the respective heaters 14*a*, 14 and 14*b* by the respective fans associated with the fan blower units 13 of each respective barn and is then delivered into the respective curing chambers 17 for such barns. The return air which is brought back to the respective heat chambers 61, 62, 63 forming the heat exchange unit 60 is drawn from the respective return air plenums 19 through the return pipes 67*a*, 68*a* and 69*a* which extract the air at a slightly positive pressure from each respective upper plenum 19 prior to the return air reaching the intake side of the respective blower chambers 22. Appropriate heat sensor controlled dampers 43–45 are situated in the respective heat return pipes 67*a*, 68*a* and 69*a* respectively and are later described. Conventional control boxes 46 are positioned at desired locations on the front of the barns 10, 11 and 12. Each barn contains a heat sensor 50 for controlling operation of the dampers 43–45 associated with the wood furnace 30 and a separate heat sensor 51 associated with controlling the oil or gas burner associated with the respective heaters 14*a*, 14, and 14*b* of the respective barns. While not illustrated, each control box 46 contains a respective thermostat control which can be set to control, in conjunction with operation of the respective heat sensor 50, the temperature at which the respective damper 43–45 of each return air pipe going back to furnace 30 operates. Each control box 46 also contains a thermostat control for controlling, in conjunction with the respective sensor 51, the temperature at which each respective oil or gas heater 14*a*, 14 and 14*b* comes on and goes off. Control boxes 46** may also contain conventional means for advancing the temperature settings at some predetermined rates. Since control devices of this kind are well-known, no further description of the control, per se, is deemed necessary for those skilled in the art.

To better illustrate how the apparatus of the invention functions, a typical curing cycle for bulk tobacco will now be described. Wood furnace 30 is fired up by placing logs inside of the furnace beneath the heat exchange unit 60 and starting a fire to ignite the logs. All of the oil or gas burners associated with the respective heaters **14*a*, 14 and 14*b* are off. However, all of the blowers 13 are on and assuming that all three barns are suitably loaded with bulk tobacco which is to be cured, all of the fan blowers 13 associated with the respective heaters 14*a*, 14 and 14*b* will be on even though the burners for such heaters will be off. This initial curing stage is called the yellowing stage and takes approximately sixty hours, plus or minus. During this stage, all heat may be derived entirely from the wood furnace 30. The respective temperatures existing in the plenum chambers 15 will be transmitted to the respective controls 46 and the associated thermostat control forming a part of each control 46 will be set for approximately 100° to 105° F. during this yellowing stage so that the respective control dampers 43–45 in the respective wood furnace heat return pipes 67*a*, 68*a* and 69*a*, respectively, will operate within the 100° to 105° F. range during this yellowing stage. Upon completion of the yellowing stage, the burners for the respective heaters 14*a*, 14 and 14*b* are energized and the thermostats in control boxes 46 associated with the respective heat sensors 51 are set at 120° F. Appropriate timers located in the respective control boxes 46 are set so as to advance the thermostat settings upward at 4° intervals each hour until the 120° F. leaf dry temperature is reached. Approximately twenty-five hours of operation is typically needed to obtain the desired color in the tobacco. During this leaf drying stage, the wood furnace 30 control thermostats associated with the respective heat sensors 50 are set at 123° to 124° F. so that the burners for the respective oil or gas heaters will cycle off prior to closing the respective wood heat air dampers 43–45 so that the burners for the respective oil or gas heaters will be energized and will operate only when furnace 30 is unable to maintain the required temperature sensed by heat sensor 50**.

In the next operation, the tobacco leaves are dried out fully. During this stage, it is desired to obtain maximum heat from the wood furnace 30. Therefore, the control thermostats in the control boxes 46 associated with the wood furnace hot air dampers 43–45 are set to their maximum setting and the thermostat controls in control boxes 46 associated with the respective oil or gas burners are set at 140° F. A temperature of approximately 140° F. is maintained in the curing chamber 17 for twenty-four to thirty-six hours. Following this stage, the thermostat controls associated with the oil or gas burners are increased to 160° to 165° F. for stem drying. In both the leaf dry and stem dry stages, the oil or gas burners associated with the heaters 14*a*, 14 and 14*b* will cycle on and off as needed while all of the dampers 43–45 stay open so as to extract the maximum heat from the wood furnace 30. Approximately six days is typically needed to cure a barn of tobacco. However, this time will vary with the weather conditions, the tobacco conditions and the fullness of the barns.

Figure 4:
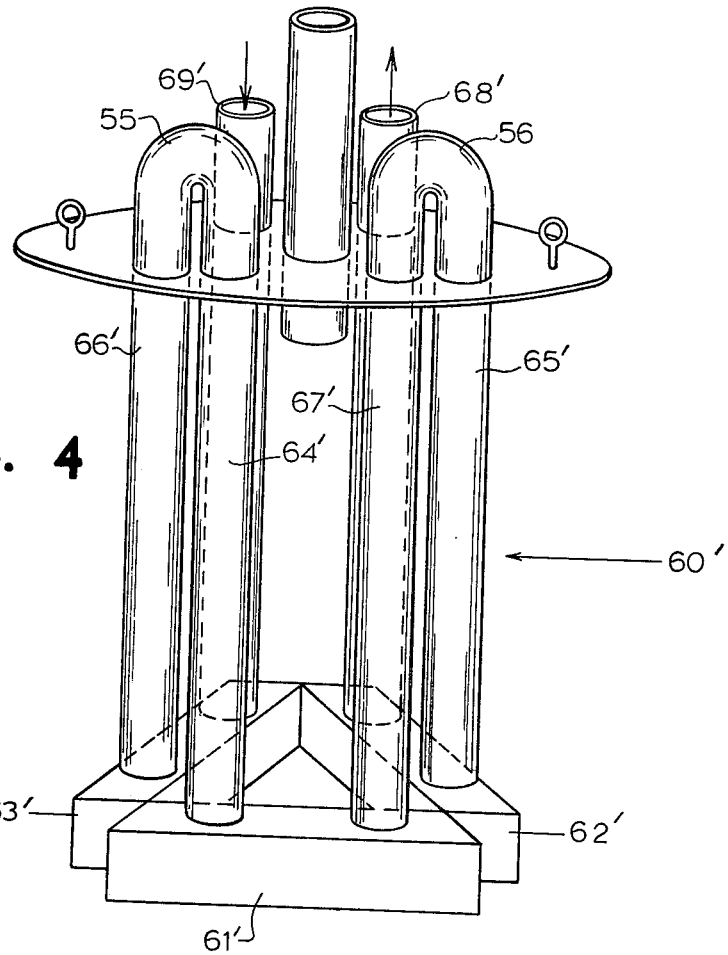
FIG. 4 is a perspective view of the heat exchange unit of the invention modified for use with a single crop drying or curing barn.

While it is anticipated that maximum utility of the unique furnace construction associated with furnace 30 will be realized when furnace 30 is used with several rather than a single barn, it is anticipated that furnace 30 may be used to advantage with a single barn by modifying the heat exchange unit 60 in the manner illustrated in FIG. 4. The modified heat exchange unit 60' shown in FIG. 4 is identical to the heat exchange unit 60 of FIG. 3 except that pipes 64' and 66' are connected so that air from chamber 63' is fed into chamber 61' through bend 55 and air from chamber 61' is fed into chamber 62' through bend 56. This arrangement allows heated air to be delivered from chamber 62' to a single barn through pipe 68' and to be returned to chamber 63' from a single barn through pipe 69'. While the respective bends 55 and 56 in FIG. 4 are shown as being formed integral with the respective pipes 64'–66' and 65'–67', it is anticipated that the bends 55–56 could be formed as removable U-shaped couplings so that a conversion from multiple barn to single barn operation or single barn to multiple barn operation could be effected by either removing or installing the respective bend portions 55–56.

Another advantage of the heat exchange unit illustrated in the drawings is that each of the respective chambers 61, 62 and 63 and their associated piping constitutes a separate heat exchange unit. Thus, when operating three barns as illustrated in FIG. 1, only one of the barns could actually be in operation while the other two barns are being loaded. In this situation, the only air which would be circulated through furnace 30 would be the air associated with the barn being used since the other heat chambers associated with the heat exchange unit 60 would effectively be inoperative. A still further advantage of the invention resides in the fact that the heat exchange unit 60 can be prefabricated. Thus, the purchaser can readily convert a conventional bulk curing tobacco barn using much of his own labor, commonly available pipes, bricks and other construction materials and with appropriate instructions as set forth in the foregoing description. The tobacco farmer in particular can thus realize significant energy savings with very modest expense.

What is claimed is:

1. A crop drying apparatus, comprising:

(a) barn structure establishing a plurality of heating compartments and for each compartment a confined path for recirculating air therethrough and which path is isolated from similar paths for the other compartments;

(b) a plurality of individually controllable burner-fired heat sources in the nature of gas or oil-fired furnaces having individually controllable associated blower means, one of said burner-fired heat sources and its associated blower means being operatively associated with each of said compartments for blowing and heating the air circulated along the path associated therewith;

(c) a wood-burning furnace located proximate said barn structure and having within the furnace a heat exchange unit establishing a plurality of separate air-heating chambers and a set of pipes associated with each chamber and extending externally of the furnace enabling separate air paths to be established through the furnace and through separate said chambers;

(d) air conduit means associated with each said compartment, said air conduit means being adapted to establish an airflow path which connects at one end to the intake side of the blower means for a selected said compartment and at another end connects to the air discharge side of the selected said compartment enabling air heated in said wood furnace to be continuously circulated through said blower means, through the selected said compartment and through one of said chambers; and (e) control means associated with said air conduit means and said burner-fired heat sources and blower means enabling each said compartment when in use to have the associated blower means operate continuously and independently of any other compartment blower means operating so as to allow each such compartment to be heated either solely by air passed through one of said furnace chambers, solely by air passed through one of said burner-fired heat sources or by air passed through both one of said chambers and one of said burner-fired furnaces and to have such air however heated to be continuously circulated through such compartment by the blower means associated therewith.

2. A crop drying apparatus, comprising:

(a) barn structure establishing at least one heating compartment and a confined path for recirculating air therethrough;

(b) blower means operatively associated with said structure and arranged to maintain the air in said path in continuous circulation in a predetermined direction through said compartment to dry any crop material contained therein;

(c) an upright wood-burning furnace having a base, above the base in a lower hollow portion of the furnace a lined wood-burning area with an access door, above the wood-burning area an upper hollow portion for collecting heated air, and within the upper hollow portion a heat exchange unit, said heat exchange unit comprising:

(i) a plurality of elongated uniformly shaped chambers positioned horizontally around the central vertical axis of the furnace;

(ii) sets of vertical air entry and exit pipes comprising for each chamber a vertical air entry pipe communicating at its lower end with one end of the chamber and having an upper end extending above the top of the furnace and a vertical air exit pipe communicating at its lower end with an opposite end of the chamber and having an upper end extending above the top of the furnace; and (iii) a plate member through which said chamber entry and exit pipes pass and adapted to enclose an opening provided in the top of said furnace and to be supported on the periphery of the furnace structure around said opening, said chambers and air entry and exit pipes being arranged for being installed through and being suspended from said plate member below said opening and to form a structural assembly with said plate member;

(iv) a centrally positioned vertical smoke pipe secured to said plate member as part of said assembly and having one lower end communicating with said upper hollow portion and an upper stack portion terminating above said plate member to discharge smoke therethrough; and (d) air conduit means connecting a selected number of said chambers and said chamber pipes associated therewith to establish an air flow path which connects at one end to the intake side of said blower means and at another end to the air discharge side of said compartment in a manner enabling air heated in said furnace by the chambers so employed to be continuously circulated through said blower means, through said compartment and through the chambers so utilized.

3. An apparatus as claimed in claim 2 wherein said barn structure comprises a plurality of barns each having a said blower means and heating compartment, said air conduit means includes separate sets of air conduit means for each barn with each set being arranged to establish a said airflow path which includes only one of said chambers and the said chamber air entry and exit pipes associated therewith and which connects at one end to the intake side of said blower means for one of said barns and at another end to the air discharge side of the heating compartment associated with such barn such that each respective said barn heating compartment when being used to dry crop material stored therein can be separately heated by passing air through one of said chambers and when not in use may have the air path passing therethrough isolated so as not to utilize heat from said furnace.

4. An apparatus as claimed in claim 3 wherein each of said plural barns includes associated with said blower means a burner-fired heat source such as an oil or gas-fired furnace and control means enabling each said barn to have its respective heating compartment heated either solely from air passing through one of said chambers of said wood furnace, in conjunction with heat supplied by said burner-fired heat source to air drawn through said blower means or solely by heat supplied by said burner-fired heat source to air drawn through said blower means.

5. An apparatus as claimed in claim 2 wherein said chambers comprise three elongated chambers of hollow rectangular cross section and arranged in an equilateral triangular configuration around the central vertical axis of said furnace.

6. An apparatus as claimed in claim 2 wherein said chamber air entry and exit pipes are adapted to be connected in series enabling an air path to be established through all of said chambers.

* * * * *